US011147390B2

(12) United States Patent
Mabon

(10) Patent No.: US 11,147,390 B2
(45) Date of Patent: Oct. 19, 2021

(54) OUTDOOR CUSHION WITH POCKETED SPRING INTERIOR

(71) Applicant: L&P Property Management Company, South Gate, CA (US)

(72) Inventor: Lewis A. Mabon, Trinity, NC (US)

(73) Assignee: L&P Property Management Company, South Gate, CA (US)

( * ) Notice: Subject to any disclaimer, the term of this patent is extended or adjusted under 35 U.S.C. 154(b) by 478 days.

(21) Appl. No.: 16/157,637

(22) Filed: Oct. 11, 2018

(65) Prior Publication Data

US 2020/0113346 A1 Apr. 16, 2020

(51) Int. Cl.
*A47C 27/06* (2006.01)
*A47C 1/14* (2006.01)
*A47C 7/34* (2006.01)

(52) U.S. Cl.
CPC ..... *A47C 27/064* (2013.01); *A47C 1/14* (2013.01); *A47C 7/34* (2013.01)

(58) Field of Classification Search
CPC ..... A47C 27/064; A47C 1/14; A47C 7/34; A47C 27/05; A47C 7/18
See application file for complete search history.

(56) References Cited

U.S. PATENT DOCUMENTS 27,667 A * 3/1860 Geraghty ..... A47C 27/05 5/716
932,024 A * 8/1909 Kalas ..... A47C 27/05 5/716
963,757 A * 7/1910 Greer ..... A47C 7/34 5/654.1
1,644,852 A * 10/1927 Ness ..... A47C 17/64 5/498
1,682,394 A * 8/1928 Meutsch ..... A47C 27/05 5/720
1,873,212 A * 8/1932 Ostroff ..... A47C 21/046 267/82
2,283,116 A 5/1942 Young
2,371,276 A * 3/1945 Adams ..... A47C 27/05 5/655.8
2,425,728 A * 8/1947 Cobb ..... A47C 27/053 5/716
2,507,586 A * 5/1950 Berkman ..... A47C 27/056 5/700
2,540,927 A * 2/1951 Bostrom ..... A47C 7/20 5/652.1

(Continued)

FOREIGN PATENT DOCUMENTS

CN 205866471 1/2017
EP 3167768 5/2017

(Continued)

*Primary Examiner* — Eric J Kurilla
(74) *Attorney, Agent, or Firm* — Wood Herron & Evans LLP

(57) ABSTRACT

A pocketed spring assembly comprises a plurality of parallel strings of individually pocketed springs. Each string is joined to at least one adjacent string. Each string has first and second opposed plies of fabric and a plurality of pockets formed along a length of the string by transverse seams joining the plies. At least one spring is positioned in each of the pockets. The water permeable fabric used to make at least some strings comprises warp knit polyester fabric.

18 Claims, 3 Drawing Sheets

(56) References Cited

U.S. PATENT DOCUMENTS 2,784,773 A * 3/1957 Rowland ..... A47C 21/046 5/652.1
2,807,033 A * 9/1957 Austen ..... A47C 21/046 5/725
2,862,214 A * 12/1958 Thompson ..... A47C 27/064 5/720
3,165,761 A * 1/1965 Ross ..... A47C 27/05 5/655.8
3,178,735 A * 4/1965 Thompson ..... A47C 27/064 5/720
3,255,469 A * 6/1966 Blecker ..... A47C 21/046 5/655.7
3,451,075 A * 6/1969 Woodard ..... A47C 31/11 5/657.5
3,581,322 A * 6/1971 Marsico ..... A47C 27/05 5/699
3,681,797 A * 8/1972 Messner ..... A47C 27/146 297/180.13
4,042,986 A * 8/1977 Goodman ..... A47C 27/05 5/500
4,914,772 A 4/1990 Difloe
4,998,311 A * 3/1991 Ernst ..... A47C 7/021 297/228.1
5,050,256 A 9/1991 Woodcock
5,189,743 A * 3/1993 Difloe ..... A47C 7/66 5/652.1
5,226,188 A * 7/1993 Liou ..... A47C 7/742 297/452.46
5,388,296 A * 2/1995 Mansour ..... A47C 21/046 5/484
5,519,907 A * 5/1996 Poths ..... A47C 27/146 5/636
5,761,784 A * 6/1998 Ogle ..... B68G 9/00 5/720
6,186,483 B1 2/2001 Bullard
6,342,456 B1 * 1/2002 Jenkins ..... D03D 15/49 442/208
6,367,881 B1 * 4/2002 Bullard ..... A47C 27/064 297/452.5
7,644,461 B2 * 1/2010 Lee ..... A47C 27/04 5/720
8,167,672 B2 5/2012 Starmer
8,176,589 B2 5/2012 Stjerna et al.
8,302,229 B1 * 11/2012 Bullard ..... A47C 27/064 5/654.1
9,332,856 B2 5/2016 Eigenmann et al.
9,332,857 B2 5/2016 Alzoubi et al.
9,808,096 B1 * 11/2017 Essenmacher ..... A47C 31/113
9,943,173 B2 * 4/2018 Krtek ..... A47C 27/05
9,968,202 B2 5/2018 Long
10,681,984 B1 * 6/2020 Lin ..... A47C 4/24
2004/0133988 A1 7/2004 Barber
2004/0237203 A1 * 12/2004 Romano ..... A47C 27/20 5/713
2010/0011509 A1 1/2010 Stjerna et al.
2013/0000043 A1 1/2013 Bullard et al.
2013/0000044 A1 * 1/2013 Bullard ..... A47C 27/064 5/654.1
2013/0127228 A1 * 5/2013 Colvin ..... A47C 1/14 297/452.65
2014/0033440 A1 * 2/2014 Tyree ..... A47C 27/148 5/706
2014/0101855 A1 * 4/2014 Call ..... A47C 27/06 5/652.1
2014/0115790 A1 * 5/2014 Romano ..... A47C 27/122 5/652.2
2015/0224006 A1 * 8/2015 Primo ..... A61G 5/1045 297/180.14
2015/0359350 A1 * 12/2015 Eigenmann ..... A47C 23/043 5/652.1
2016/0045034 A1 2/2016 Hager et al.
2016/0235213 A1 * 8/2016 Long ..... A47C 21/046
2016/0270546 A1 9/2016 Codos
2016/0367042 A1 12/2016 Fisher
2017/0035203 A1 2/2017 Mezzera
2019/0145153 A1 * 5/2019 Edelman ..... A47C 7/62 297/188.01
2019/0150630 A1 * 5/2019 Codos ..... A47C 27/07
2019/0281989 A1 * 9/2019 Line ..... B32B 5/24

FOREIGN PATENT DOCUMENTS

KR 101393469 5/2014
WO 2017137754 8/2017

* cited by examiner

OUTDOOR CUSHION WITH POCKETED SPRING INTERIOR

FIELD OF THE INVENTION

This invention relates generally to fabric for use in outdoor seating products and, more particularly, for use in pocketed spring assemblies used in outdoor seating products.

BACKGROUND OF THE INVENTION

Outdoor furniture has been continuously growing in popularity over the years. Recent developments have focused primarily on outdoor furniture that more closely resembles indoor furniture. For example, outdoor upholstered furniture has become popular. However, it is difficult to make such furniture as comfortable as indoor upholstered furniture. For example, outdoor seat cushions and back pillows have primarily been constructed of multiple layers of densified polyester fiber batting. When enough fiber is used, the cushion can be supportive of a seating load, but the support has a "dead" feel, resulting from the tightly packed fibers, without any other source of resilience.

In an attempt to address this deficiency, some manufacturers have made outdoor furniture with stainless steel wire coils to provide resilience. These coils are typically contained in fabric pockets constructed of a non-woven polypropylene pocketing material that unitizes the coils into a cushion core. The pocketing material is often treated for water repellency to inhibit water, such as rainwater, from entering the pockets. Nevertheless, rainwater or other liquid invariably enters the pockets and subsequently becomes trapped therein due to the non-woven polypropylene pocketing material and/or water repellant treatment thereof. This trapped water can lead to undesirable mold or mildew in the pockets and degradation of the cushion.

Thus, there exists a need for an improved outdoor cushion with a pocketed spring core that overcomes these and other deficiencies.

SUMMARY OF THE INVENTION

According to one aspect of the present invention, an outdoor cushion comprises a pocketed spring assembly comprising a pocketed spring core including a plurality of pockets and a breathable fabric outside the pocketed spring core, wherein the pockets of the pocketed spring core are constructed of warp knit polyester fabric.

According to another aspect of the present invention, an outdoor seating product incorporates a novel pocketed spring assembly. The pocketed spring assembly comprises a plurality of parallel strings of springs joined together. Each string is joined to at least one adjacent string. Each string comprises a plurality of aligned individually pocketed springs. Each string comprises a water permeable fabric folded around multiple springs to create first and second opposed sides of fabric covering opposite surfaces of the springs. The water permeable fabric is joined to itself along a longitudinal seam which may extend along one of the sides of the string of springs. Pockets are formed along the length of the string of springs by transverse or separating seams joining the first and second sides covering opposite surfaces of the springs, at least one spring being positioned in each pocket.

The outdoor seating product may further comprise cushioning material and a covering encasing the pocketed spring assembly and cushioning materials.

In some embodiments, the water permeable fabric used to make at least one of the strings of springs comprises warp knit polyester fabric. However, any water permeable fabric may be used. In some embodiments, plies of the water permeable fabric are ultrasonically welded together. The ultrasonic welds may be located at various locations throughout the piece of fabric.

According to another aspect of the invention, a pocketed spring assembly for use in an outdoor seating product comprises a plurality of parallel strings of springs joined together. Each string comprises a plurality of individually pocketed springs and a water permeable fabric. The water permeable fabric is joined to itself along a longitudinal seam and has first and second opposed sides covering opposite surfaces of the springs. A plurality of pockets is formed along a length of the string of springs by transverse seams joining the first and second sides, at least one spring being positioned in each said pocket.

According to another aspect of the invention, the water permeable fabric used to make a string of springs comprises warp knit polyester fabric. The pocketed spring assembly may further comprise a covering, which may be breathable. In one embodiment, the water permeable fabric used to make a string of springs includes two plies joined together at multiple locations. The plies may be ultrasonically welded together at multiple locations, for example.

According to another aspect, a string of springs for use in a pocketed spring assembly comprises a plurality of individually pocketed springs, and a water permeable fabric joined to itself along a longitudinal seam. First and second opposed plies of the water permeable fabric are on opposite sides of the springs. A plurality of pockets are formed along a length of the string by transverse seams joining the first and second plies of the water permeable fabric. At least one spring is positioned in each of the pockets. The water permeable fabric may comprise warp knit polyester fabric. The water permeable fabric may include two plies joined together at multiple locations. For example, the two plies may be ultrasonically welded together at multiple locations The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
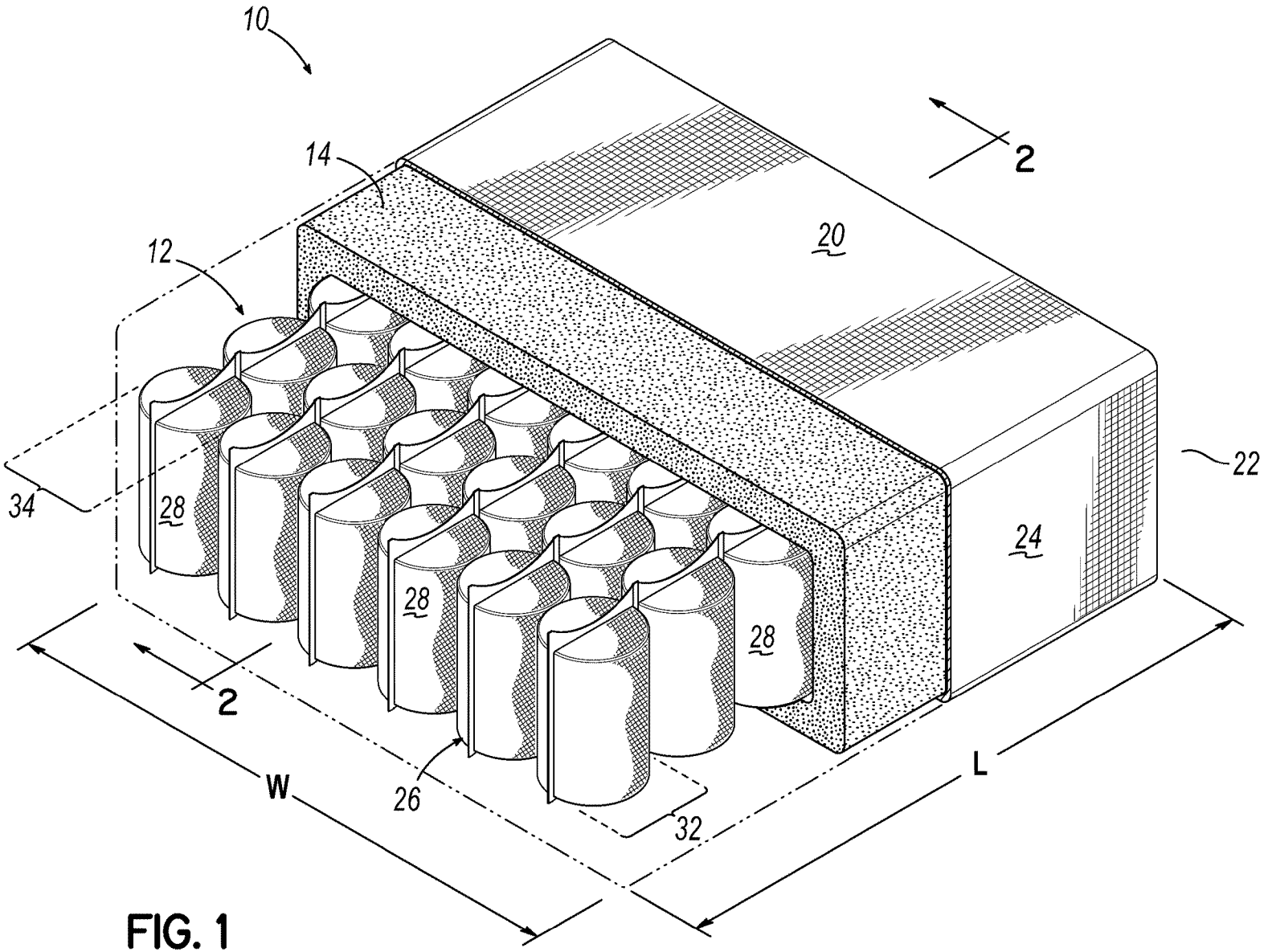
FIG. 1 is a perspective view, partially broken away, of an outdoor seating product incorporating a pocketed spring assembly made in accordance with the present invention.

Referring first to FIG. 1, there is illustrated an outdoor seating product in the form of a cushion 10 incorporating the principles of the present invention. This cushion 10 comprises a pocketed spring assembly 12 about which is wrapped a conventional padding or cushioning layers 14 which may be foam, fiber, one or more scrim sheets or any other suitable materials or any combination thereof, and all components are enclosed within an upholstered covering material 20. In the embodiment shown, the cushioning layer 14 is wrapped about the entire pocketed spring assembly 12. However, any configuration and/or number of cushioning layers 14 may be used and positioned in any suitable arrangement. For example, a single cushioning layer 14 may be positioned over the top of the pocketed spring assembly 12.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1, the length and width are illustrated as being identical, such that the product 10 is square. However, it is within the scope of the present invention that the length and width may be different. For example, the length may be greater than the width, as in a rectangular product.

As shown in FIG. 1, pocketed spring assembly 12 is manufactured from multiple strings 26 of pocketed springs 28 joined together. In pocketed spring assembly 12 shown in FIG. 1, each string 26 of pocketed springs 28 extends longitudinally or from end-to-end along the full length of the pocketed spring assembly 12. Although the strings 26 of pocketed springs 28 are illustrated as extending longitudinally or from end-to-end in the pocketed spring assembly 12 of FIG. 1, the strings 26 may extend transversely or from side-to-side.

Strings 26 of pocketed springs 28 and any other strings of springs described or shown herein, may be connected in side-by-side relationship as, for example, by gluing the sides of the strings 26 together in an assembly machine, to create an assembly or matrix of springs having multiple rows and columns of pocketed springs 28 bound together as by gluing, welding or any other conventional assembly process commonly used to create pocketed spring cores or assemblies. For example, strings 26 of pocketed springs 28 may be connected to each other by hot melt adhesive.

As shown, the longitudinally extending strings 26 of pocketed spring assembly 12, along with any other strings described or shown herein, may be joined so that the individually pocketed springs 28 are aligned in transversely extending rows 32 (extending from side-to-side) and longitudinally extending columns 34 (extending from end-to-end). Alternatively, the longitudinally extending strings 26 of pocketed spring assembly 12, along with any other strings described or shown herein, may be offset from one another. In such an arrangement, the individually pocketed springs 28 are not aligned in rows and columns; instead the individually pocketed springs 28 fill voids of the adjacent strings. Either alignment of strings may be incorporated into any of the pocketed spring assemblies or cores illustrated or described herein.

Figure 2:
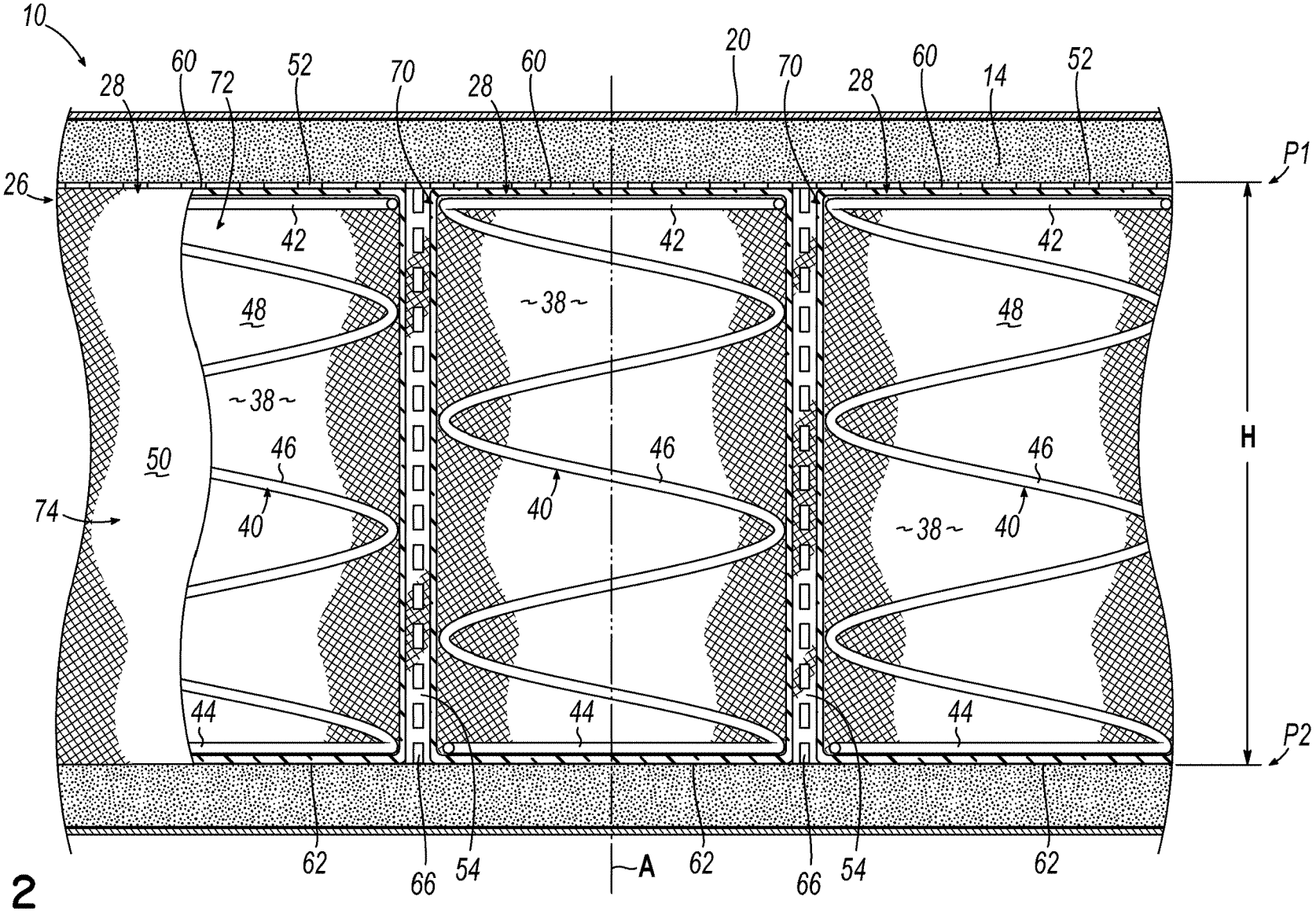
FIG. 2 is partial cross sectional view of a portion of one of the strings of springs of FIG. 1, taken along section line 2-2, showing the string of springs in an unloaded condition.

FIG. 2 illustrates a cross sectional view of a portion of a string 26 of pocketed springs 28 in a relaxed condition under no external load. As best illustrated in FIG. 2, each string 26 of pocketed springs 28 comprises a row of interconnected fabric pockets 38. Each of the fabric pockets 38 contains at least one resilient member, such as a coil spring 40. The coil spring 40 is preferably made of one piece of wire of a uniform diameter, but may be made of other materials, multiple strands of twisted wire and/or may be a non-uniform diameter, such as a barrel-shaped spring. The coil spring 40 may be constructed of stainless steel or other corrosion-resistant material.

As best shown in FIG. 2, each coil spring 40 has a central or longitudinal axis A, an upper end turn 42, a lower end turn 44 and a plurality of central convolutions 46 between the end turns. FIG. 2 illustrates a coil spring 40 in which the diameter of the end turns 42, 44 is generally identical to the diameter of the central convolutions 46. However, any known coil spring may be used inside any the fabric pockets 38. Not all coil springs within a pocketed spring assembly need be identical.

Preferably, a water permeable and breathable fabric 70 is used to create the string 26 of pocketed springs 28. The water permeable fabric 70 is permeable and breathable to waterflow and airflow through the fabric itself due to the nature of the fabric. For example, water can flow into the pocket 38 from above the top surface 60 through the fabric of the top surface 60, and out of the pocket 38 to below the bottom surface 62 through the fabric of the bottom surface 62. Thus, water such as rain water may avoid becoming trapped within a pocket 38. In addition, air may move between adjacent fabric pockets 38 and into and out of the string 26 through the water permeable fabric 70.

The water permeable fabric 70 is folded over onto itself around multiple coil springs 40. As best shown in FIG. 2, opposite sides 48, 50 of the water permeable fabric 70 are welded or otherwise secured together in segments to create a longitudinal segmented seam 52 joining two plies, one ply 72, 74 being on each side 48, 50 of the string. Similarly, opposite sides 48, 50 of the water permeable fabric covering opposed surfaces of the springs 40 are welded or otherwise secured together in segments to create a plurality of separating or transverse segmented seams 54, each separating or transverse segmented seam 54 joining two plies, one ply 72, 74 being on each side 48, 50 of the string. Any suitable number of plies 72, 74 may be used, such as one or more than two. FIG. 2 illustrates side 50 being closest to the reader and side 48 being behind the coil springs 40.

As shown in FIG. 2, in the absence of being subjected to a load, the string 26 of pocketed springs 28 has a generally planar top surface 60 in a top plane P1 and a parallel generally planar bottom surface 62 in a bottom plane P2. The linear distance between the top and bottom surfaces of the string 26 of pocketed springs 28 defines a height H of the string 26 of pocketed springs 28. This linear distance further defines the height H of the pocketed spring assembly 12 because each of the strings 26 has the same height. However, it is within the contemplation of the present invention that the strings be different heights.

The longitudinal seam 52 may comprise multiple spaced linear weld segments formed using an ultrasonic welding horn and anvil (not shown) as disclosed in U.S. Pat. Nos. 9,943,173 and 9,968,202 which are fully incorporated by reference herein. At least some of the longitudinal seams 52 of a string may not be segmented or be only partially segmented. For example, the longitudinal seam 52 of a string may not be segmented at all. Each transverse or separating seam 54 may comprise multiple spaced linear weld segments 66 formed using an ultrasonic welding horn and anvil (not shown) to join the opposed sides 48, 50 of the water permeable fabric 70 as disclosed in U.S. Pat. Nos. 9,943,173 and 9,968,202. Again, at least some of the transverse or separating seams 54 of a string may not be segmented or may be only partially segmented. For example, one or more transverse seams 54 of a string may be partially segmented or not be segmented at all.

Although the weld segments in the embodiments shown are illustrated as being heat-welded spaced rectangular-shaped segments, any of the seam segments may be other shapes, such as spaced dots, ovals or triangles of any desired sizes.

Figure 3:
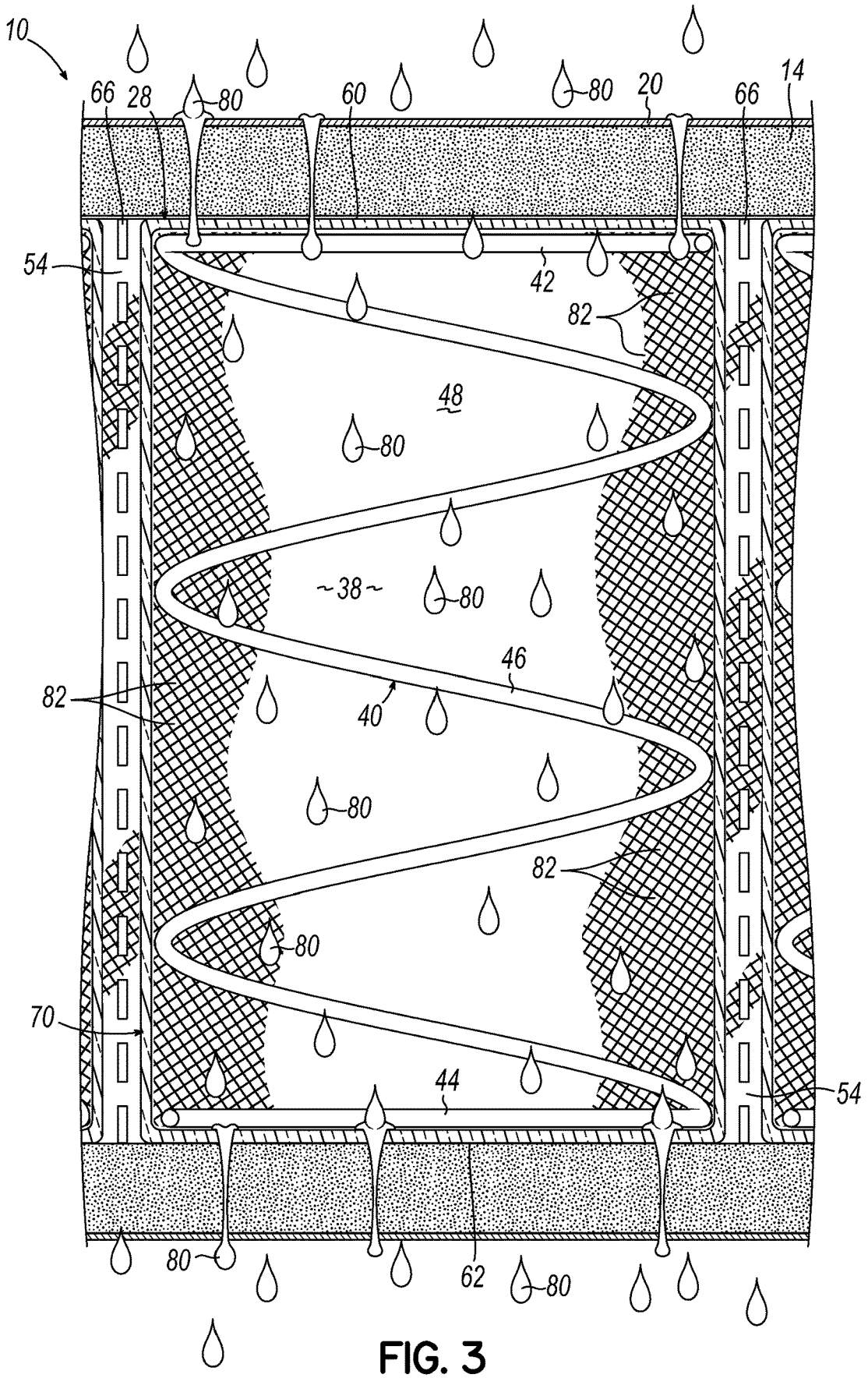
FIG. 3 is a cross sectional view of one of the spring pockets of FIG. 2, showing water passing therethrough.

As best shown in FIG. 3, the fabric material 70 of each of the strings 26 is permeable to waterflow and airflow therethrough. For example, water droplets 80 may pass through the water permeable top surface 60 into the pocket 38. Rather than remaining trapped within the pocket 38, the water droplets 80 may subsequently pass through the water permeable bottom surface 62 of the pocket 38 to thereby exit the pocket 38. Water droplets 80 may also pass through a side 48, 50 of the pocket 38. Thus, any water that enters the pocket 38 may rapidly exit the pocket 38. In this manner, water droplets 80 may flow freely through the pocket assembly 12 thereby avoiding undesirable water accumulation or moisture buildup within the pockets 38. The breathability of the fabric material 70 may further allow air to pass through the pockets 38 to assist in quickly drying any lingering moisture. This may assist in avoiding the propagation of mold and/or mildew in the pockets 38 and thereby assist in prolonging the useful life of the product 10. The breathability of the fabric material 70 may also provide a cooling effect to a user of the product 10.

In one embodiment, the fabric material 70 may be a warp knit polyester fabric. More specifically, the fabric material 70 may be a warp knit polyester fabric commercially available from Hanes Industries of Conover, N.C. In one embodiment, the fabric material 70 is a mesh material, such as a fine mesh material. For example, a plurality of fine apertures 82 may be provided throughout the fabric material 70. However, any fabric material 70 that is permeable to water or that is modified to be permeable to water may be used. For example, the fabric material 70 may be any other open knit fabric, or may be a perforated nonwoven material having perforations that are sized to provide water permeability. In addition or alternatively, the fabric material 70 may have limited stretch, such as for containing any preload of the pocketed springs 28.

In the embodiment shown, the cushioning layer 14 and covering material 20 are also constructed of water permeable and/or breathable materials for allowing water such as the water droplets 80 to pass therethrough to assist in allowing water to flow freely into and out of the pockets 38. In this manner, water may freely flow through the entire product 10 without becoming trapped therein.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of those features. Accordingly, the scope of the invention shall be limited only by the following claims and their equivalents.

What is claimed is:

1. An outdoor seating product comprising:

a pocketed spring assembly comprising a plurality of parallel strings of springs joined together, each of the strings of springs comprising a plurality of individually pocketed springs, each of the strings of springs comprising a water permeable, warp knit polyester fabric weldable to itself, the water permeable fabric being joined to itself along a longitudinal seam, having first and second opposed sides covering opposite surfaces of the springs, a plurality of pockets being formed along a length of the string of springs by transverse seams joining the first and second sides, at least one coil spring being positioned in each said pocket, each of the coil springs having end turns and central convolutions of the same diameter;

cushioning materials wrapped around the entire pocketed spring assembly; and a covering encasing the pocketed spring assembly and cushioning materials.

2. The outdoor seating product of claim 1, wherein the cushioning materials are water permeable.

3. The outdoor seating product of claim 1, wherein the covering is breathable.

4. The outdoor seating product of claim 1, wherein the water permeable fabric includes two plies joined together at multiple locations.

5. The outdoor seating product of claim 1, wherein the water permeable fabric includes two plies ultrasonically welded together at multiple locations.

6. An outdoor seating product comprising:

a pocketed spring assembly comprising plurality of parallel strings of springs joined together, each of the strings of springs comprising a plurality of individually pocketed springs, each of the strings of springs comprising a water permeable fabric weldable to itself, the water permeable fabric being joined to itself along a longitudinal seam, having first and second opposed sides covering opposite surfaces of the springs, a plurality of pockets being formed along a length of the string of springs by transverse seams joining the first and second sides, at least one coil spring being positioned in each said pocket, each of the coil springs having end turns and central convolutions of the same diameter; and cushioning materials wrapped around the pocketed spring assembly.

7. The outdoor seating product of claim 6, wherein the strings of springs extend longitudinally.

8. The outdoor seating product of claim 6, further comprising:

a covering.

9. The outdoor seating product of claim 8, wherein the covering is breathable.

10. The outdoor seating product of claim 6, wherein the water permeable fabric includes two plies joined together at multiple locations.

11. The outdoor seating product of claim 6, wherein the water permeable fabric includes two plies ultrasonically welded together at multiple locations.

12. An outdoor seating product comprising:

a pocketed spring assembly comprising strings of springs, each string comprising a plurality of individually pocketed springs, said string of springs comprising a water permeable, polyester fabric joined to itself along a longitudinal seam, first and second opposed plies of the water permeable fabric being on opposite sides of the springs, a plurality of pockets being formed along a length of the string by transverse seams joining the first and second plies of the water permeable fabric, at least one coil spring having end turns and central convolutions of the same diameter being positioned in each of the pockets; and a cushioning layer wrapped about the pocketed spring assembly.

13. The string of springs of claim 12, wherein the water permeable, polyester fabric includes two plies joined together at multiple locations.

14. The string of springs of claim 12, wherein the water permeable, polyester fabric includes two plies ultrasonically welded together at multiple locations.

15. An outdoor seating product comprising:

a pocketed spring assembly comprising a plurality of parallel strings of springs joined together, each of the strings of springs comprising a plurality of individually pocketed springs, each of the strings of springs comprising a water permeable fabric, the water permeable fabric having first and second opposed sides covering opposite surfaces of the springs, a plurality of pockets being formed along a length of the string of springs by transverse seams joining the first and second sides, at least one coil spring being positioned in each said pocket, each of the coil springs having end turns and central convolutions of the same diameter;

a cushioning layer wrapped about the entire pocketed spring assembly; and a covering encasing the pocketed spring assembly and cushioning layer.

16. The outdoor seating product of claim 15, wherein the cushioning materials are water permeable.

17. The outdoor seating product of claim 15, wherein the covering is breathable.

18. The outdoor seating product of claim 15, wherein the water permeable fabric includes two plies ultrasonically welded together at multiple locations.

* * * * *